United States Patent [19]

MacFarlane et al.

[11] 4,144,596

[45] Mar. 20, 1979

[54] WATER SUPPLY CONTROL FOR AUTOMATIC HAND WASHING AND DRYING APPARATUS

[75] Inventors: Thomas R. MacFarlane; Richard G. Sickert, both of St. Joseph, Mich.

[73] Assignee: Whirlpool Corporation, Benton Harbor, Mich.

[21] Appl. No.: 866,173

[22] Filed: Dec. 30, 1977

[51] Int. Cl.[2] ..... A47K 1/04

[52] U.S. Cl. ..... 4/166; 4/167; 4/187 R; 4/DIG. 3

[58] Field of Search ..... 4/166, 167, 187 R, 145, 4/191, 192, 249, DIG. 3, 6, 7

[56] References Cited

U.S. PATENT DOCUMENTS

| | | | |
|---|---|---|---|
| 1,494,883 | 5/1924 | Bassette et al. | 4/166 |
| 1,765,915 | 6/1930 | Haase | 4/167 |
| 2,281,370 | 4/1942 | Morrison et al. | 4/166 |
| 2,315,958 | 4/1943 | Hill et al. | 171/97 |
| 3,154,793 | 11/1964 | Congdon | 4/7 |
| 3,247,524 | 4/1966 | Umann | 4/7 |
| 3,298,037 | 1/1967 | Luther | 4/166 |
| 3,311,795 | 3/1967 | Gilbert | 317/137 |
| 3,415,278 | 12/1968 | Yamamoto et al. | 4/166 X |
| 3,505,692 | 4/1970 | Forbes | 4/166 |
| 3,551,919 | 1/1971 | Forbes | 4/166 UX |
| 3,594,826 | 7/1971 | Maurar | 4/7 |
| 3,639,920 | 2/1972 | Griffin et al. | 4/166 |
| 3,691,431 | 9/1972 | Hendrickson et al. | 317/137 |

*Primary Examiner*—Henry K. Artis

*Attorney, Agent, or Firm*—Wegner, Stellman, McCord, Wiles & Wood

[57] ABSTRACT

An improved control for use in a hand washing and drying apparatus including a first manually operable control device for causing operation of a solenoid-operated valve causing delivery of hand washing water directly to a bowl of the device for a preselected period of time. A second manually operable control device is provided for causing operation of a forced air drying structure of the device to provide hand drying air to the bowl. The control is arranged to prevent concurrent operation of the solenoid and air moving device. The control is further arranged to prevent concurrent operation of the electric heater of the water supply and the blower motor. Still further, the control is arranged to prevent concurrent operation of the solenoid valve of the water supply and the blower motor. The control is arranged to limit usage of electrical power so that a single conventional branch circuit can provide sufficient power to operate the device. The control provides an improved short delivery of the washing water so as to effectively require a number of manipulations of the manually operable control to effect a complete hand washing operation while continually maintaining an adequate supply of warm water for subsequent users. The device is arranged to permit substantially continuous sequential use thereof by a number of users as in a public restroom in effecting a series of hand washing and drying operations while providing the hand washing water in sufficient volume at the desired hand washing temperature to accommodate a series of users.

22 Claims, 10 Drawing Figures

FIG. 6
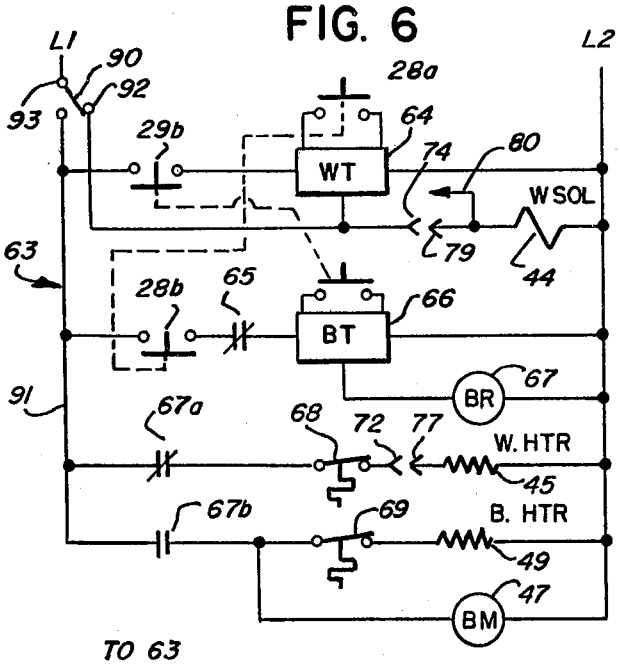
FIG. 10
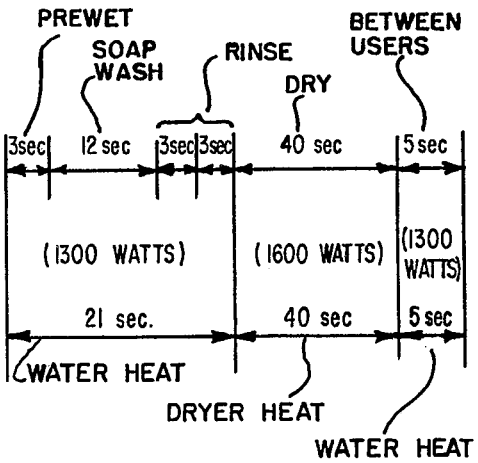
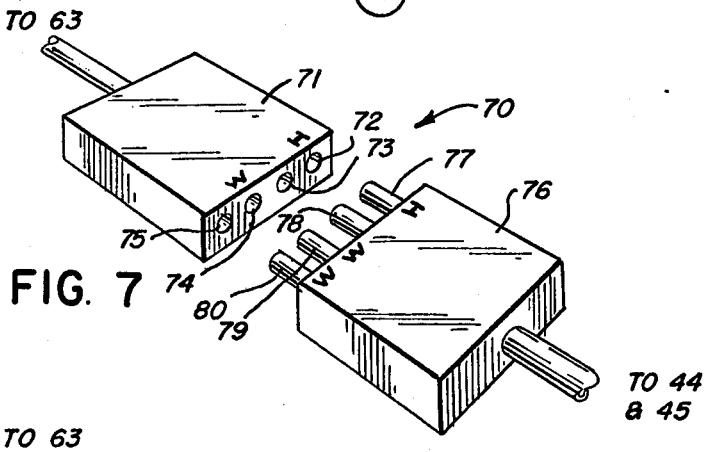
FIG. 7
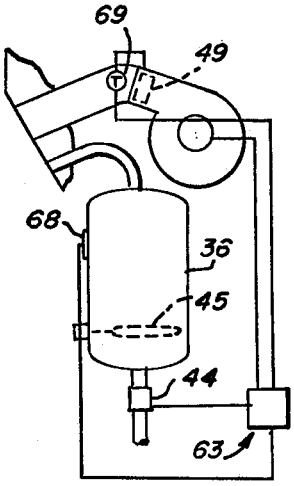
FIG. 9
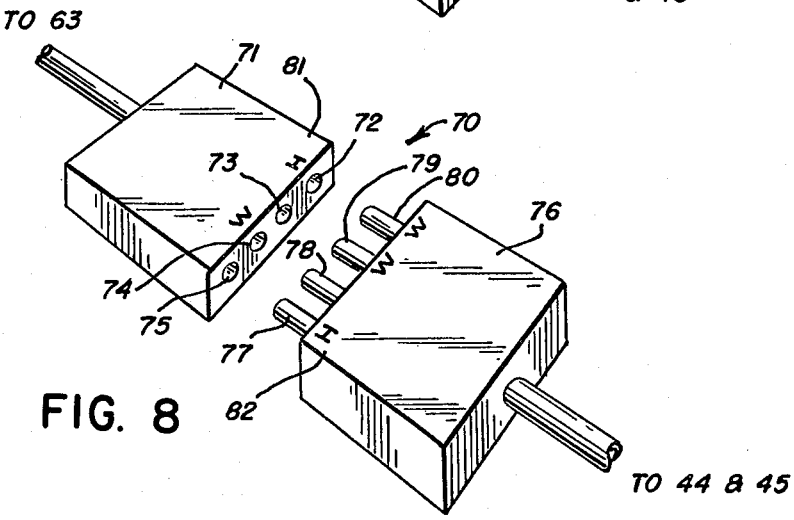
FIG. 8

WATER SUPPLY CONTROL FOR AUTOMATIC HAND WASHING AND DRYING APPARATUS

BACKGROUND OF THE INVENTION

1. Field of the Invention

This invention relates to lavatories, and more specifically to hand washing and drying apparatuses.

2. Description of the Prior Art

The use of conventional lavatory sinks with adjacent towel or forced air hand drying means in public washrooms and the like is well known. A number of automatic devices have been developed for use in carrying out such hand washing and drying operations.

More specifically, as shown in U.S. Pat. No. 1,765,915 of Oscar Haase, an automatic apparatus for providing water, soap, hot air, and perfume for use in a hand washing and drying operation is illustrated. The apparatus is coin-operated so as to provide preselected times of delivery during the different delivery operations. Illustratively, the liquid soap is discharged for approximately five seconds, the washing water is delivered for approximately 20 seconds, and the drying air is delivered for approximately 40 seconds. The perfume may be delivered in the relatively short time of approximately three seconds. The apparatus is contained in a casing and thus is self-contained independently of any bowl or other means defining a hand washing and drying space. The delivery ducts are defined by a common discharge pipe aimed directly downwardly from the bottom of the casing. However, no bowl is provided for performing the hand washing and drying operation.

In U.S. Pat. No. 2,192,383 of Walter W. Krolop, a lavatory is shown including a hand washing bowl. A water-containing tank and liquid soap-containing tank are built into an upper portion of a cabinet partially enclosing the bowl. A water outlet is mounted in the upper portion of the bowl with a soap dispenser mounted to extend forwardly of the water outlet. A heater, such as a kerosene heater, is provided within the cabinet for heating the hand washing water in the tank. The water outlet is aimed parallel to the upper rim of the bowl. The soap dispenser is actuated by the user's hands within the bowl space, and the hot water delivery is effected by means of operation of a foot treadle engaged by the user's foot during the hand washing operation. No hand drying structure is provided in the Krolop lavatory.

Willard L. Morrison et al disclosed, in U.S. Pat. No. 2,281,370, a combination washroom fixture having a conventional cabinet-mounted sink provided with hot and cold water faucets. The cabinet is filled with hot air heated by a heating coil and a blower is provided therein having a discharge flexible tube extending upwardly from a rear apron portion of the sink permitting the nozzle thereof to be pulled out to a desired position such as for drying the user's hands or hair. A foot pedal is disclosed for operating the dryer fan motor. The hot air in the cabinet is used to heat the room in which the device is mounted at times when the air is not being delivered through the discharge nozzle. The outlets to the room are closed by a suitable control device when it is desired to use the discharge nozzle. In the normal position, the discharge nozzle is aimed directly forwardly over the top of the sink, with the flexible hose connection thereof permitting selective positioning of the nozzle as desired by the user.

In U.S. Pat. No. 2,328,129, Buyon L. C. Earle shows a drier arrangement for dishes wherein heated air is delivered to a compartment above the rear of a sink so as to dry dishes or the like placed in the compartment after having been washed in the sink.

Louis L. Siegel, in U.S. Pat. No. 2,504,740, shows a combination soap-dispensing device and hand dryer which are mounted in a housing adapted to be attached to a wall by suitable brackets so as to be disposed immediately above or adjacent a washbowl. The heated air is directed in a first path for drying the user's hands and in a second path for drying soap in the soap container. The device includes granulating means for providing granulated particles of soap from a bar provided within the soap dispenser.

Other prior art disclosures showing structures which may be useful in the control of apparatus for hand washing and drying operations include the following U.S. Letters Patent:

| Patent No. | Inventor | Title |
|---|---|---|
| 1,494,883 | Bassette et al | Lavatory Fixture |
| 2,299,053 | Ferris | Water Heater |
| 2,315,958 | Hill et al | Control System |
| 3,007,178 | Altman et al | Combination Steam Bath and Shower |
| 3,311,795 | Gilbert | Electronic Interlock Circuit |
| 3,466,505 | Anderson | Relay Interlock Circuit |
| 3,470,425 | Simon | Lock-Out Circuit Arrangement |
| 3,639,920 | Griffin et al | Programmed Plumbing Service |
| 3,691,431 | Hendrickson et al | Interlocked Selection Control Apparatus |

SUMMARY OF THE INVENTION

The present invention comprehends an improved hand washing and drying device having a bowl defining a hand washing and drying space, a water supply including a shutoff valve operated by a water solenoid for delivering hand washing water to the space, and a forced air drying means delivering hand drying air to the bowl space. An improved control is provided in the device including first manually operable control means for causing operation of the solenoid for a first preselected period of time to deliver hand washing water to the space for said preselected period, second manually operable control means for causing operation of the forced air drying means for a second preselected period of time to deliver hand drying air to the space for the second preselected period, and means for preventing concurrent operation of each of the solenoid and forced air drying means.

In the illustrated embodiment, the water supply includes a water heating means and the control includes means for preventing operation of the water heating means whenever the blower of the forced air drying means is caused to be operated.

The invention further comprehends the arrangement of the control whereby the first period of time is preselected to preclude a complete washing and rinsing of the user's hands during one such period. Thus, the invention comprehends the requiring of a plurality of successive manipulations of the first manually operable control means to effect sequentially a plurality of deliveries of warm water to effect the complete washing and rinsing of the user's hands. By making the preselected warm water delivery time relatively short, the user is effectively caused to utilize the warm water efficiently. Thus, the user may first wet his hands, for a short period such as three seconds, by manipulating the warm water control button, may then apply soap to his hands by suitably operating the soap dispenser, may then cause a second short time period delivery of washing water by a second manipulation of the water delivery control button, permitting the user to effectively wash his hands with the soap and second water delivery, and then effect a further delivery of warm water by a further manipulation of the warm water delivery button so as to effectively rinse the dirty water from his hands into the drain of the bowl in which the hand washing operation is conducted.

In the illustrated embodiment, the first preselected period of time is approximately three seconds during each of the operations of the warm water delivery means effected by manipulation of the manual control button. The control is arranged so that once the button is pushed, the delivery goes through one single warm water delivery cycle notwithstanding a repeated pushing of the button during the delivery time, or a maintained holding down of the button during the delivery time.

The delivery of the water to the bowl further effects an automatic rinsing of the bowl upon completion of the washing operation by the final rinse water delivered to the user's hands.

The device further includes an electric heater for heating water in a suitable tank provided therein, thereby to provide the washing water through an outlet to the bowl at a preselected hand washing temperature. A suitable solenoid valve is provided for controlling the delivery of the water for the desired preselected period of time as an incident of the user pushing the manually operable control button, as discussed above.

The invention further comprehends the provision of drying air to the user's hand in the bowl space, permitting the user to both wash and dry his hands without substantially removing his hands from the bowl space. The delivery of the hand drying air is effected by a suitable manipulation by the user of a control button controlling the operation of a motor operated blower. The air may be delivered from the blower through a suitable heating coil illustratively having a low wattage, such as 1600 watts, for effectively warming the air before delivery thereof through an outlet mounted in the bowl to provide optimum efficiency in the drying operation. Not only does the directing of the air into the bowl permit the user to retain his hands within the bowl subsequent to the operation thereby avoiding dropping of water on the subjacent floor, but also, the directing of the air into the bowl causes the warm air to circulate both downwardly onto and upwardly about the user's hands for improved drying thereof.

The control is arranged so as to discontinue energization of the electric heating coil of the warm water supply means whenever the blower is being operated to deliver drying air to the user's hands. In the illustrated embodiment, the hand drying operation is arranged to be automatically conducted for a preselected period of time, such as 40 seconds, and thus, the electric heating coil of the water heater is de-energized for a period of 40 seconds during the drying operation while being effectively energizable under the control of the thermostat at other times to maintain the temperature of the water in the warm water tank at the desired preselected hand washing temperature, which may be in the range of approximately 90° F. to 105° F.

The control is arranged so that once a pushbutton for control of the supply of hand drying air is pushed, the delivery of hand drying air is initiated and continues through one complete hand drying air delivery cycle despite repeated manipulations of the pushbutton control during the time period of the delivery cycle, or a continuously maintained holding down of the pushbutton during the time period.

The control is also arranged so that the hand drying air delivery cycle can be interrupted before completion, and thereby shortened, by pushing a pushbutton for control of the supply of warm water during the hand drying air delivery cycle. Further, the control is arranged so that if the hand drying air delivery cycle is interrupted before completion, and thereby shortened, the control will reset itself. Thus, the next time a hand drying air delivery cycle is started by pushbutton actuation, a complete hand drying air delivery cycle will be initiated which will extend through the full preselected period of time.

The warm water tank is preselected to have a capacity of substantially greater than three times the quantity of water delivered therefrom during each first preselected period of time. The electric heating coil may be of relatively low wattage, such as 1300 watts, while yet effectively providing sufficient warm water for continuous hand washing and drying cycles to be effected in conformity with the above discussed parameters.

It is contemplated that a complete cycle of operation of the hand washing and drying device extends for approximately one minute. The individual operations may be effected by the user in any desired sequence. The device may be utilized for merely rinsing the user's hands if desired.

As all manipulations required by the user in effecting a complete washing and drying cycle are carried out in or at the top of the bowl space, the improved control means of the present invention provides for a facilitated sanitary hand washing and drying operation in an extremely simple and novel manner.

BRIEF DESCRIPTION OF THE DRAWING

Other features and advantages of the invention will be apparent from the following description taken in connection with the accompanying drawing wherein:

FIG. 6 is a schematic wiring diagram of the control thereof;

FIGS. 7 and 8 are isometric views of a control plug which may be used to provide selective energization of the elements of the device so as to effectively preclude energization of the electric water heater until the warm water tank is filled with water upon initial installation of the device;

FIG. 9 is a schematic side elevation illustrating the arrangement of a number of elements of the control relative to the structural elements of the device; and FIG. 10 is a time chart illustrating the timing of the operations in a complete hand washing and drying cycle of the apparatus.

DESCRIPTION OF THE PREFERRED EMBODIMENT

Figure 3:
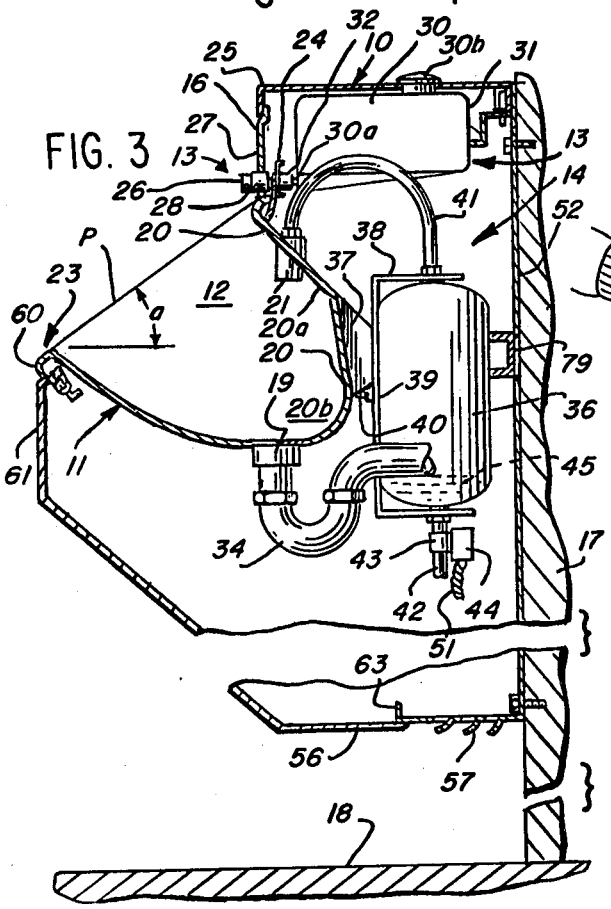
FIG. 3 is a fragmentary vertical section taken substantially along the line 3—3 of FIG. 2.

In the exemplary embodiment of the invention as disclosed in the drawing, a hand washing and drying device generally designated 10 is shown to include a bowl 11 defining a hand washing and drying space 12. These are provided for supplying hand washing material, including a soap dispenser 13 and a warm water supply 14. Means 15 are provided for supplying hand drying air. The bowl is mounted in a cabinet 16 which, as shown in FIG. 1, is arranged to be mounted to a suitable wall 17, as shown in FIG. 3 in vertically spaced relationship to a subjacent floor 18.

The hand washing and drying device to which the present invention relates is described in co-pending U.S. application Ser. No. 866,175 of Lester H. Hinkel and Lawrence E. Wolske entitled "Automatic Hand Washer and Drier" (PA-4971-0-MI-USA) filed Dec. 30, 1977, owned by the assignee hereof. The mounting of the warm water supply means on the bowl structure and the mounting of the means for supplying hand drying air on the bowl structure are described in co-pending U.S. application Ser. No. 866,176, of Lester H. Hinkel and Robert M. Chandler entitled "Hand Washer and Drier Mounting Structure" (PA-4972-0-MI-USA) filed Dec. 30, 1977, owned by the assignee hereof. The automatic operation of the hand washing and drying device and the controls employed in the automatic operation of the device are also described in co-pending U.S. application Ser. No. 866,172 of Thomas R. MacFarlane and Richard G. Sickert entitled "Automatic Hand Washing and Drying Apparatus" (PA-4973-0-MI-USA) filed Dec. 30, 1977 and owned by the assignee hereof.

The ornamental design of the preferred embodiment of the invention is disclosed and claimed in co-pending United States Design patent application Ser. No. D-866,174 of Lawrence E. Wolske entitled "Multi-Purpose Plumbing Fixture Bowl and Cabinet Assembly" (PD-4974-0-MI-USA), filed Dec. 30, 1977 and owned by the assignee hereof.

Figure 1:
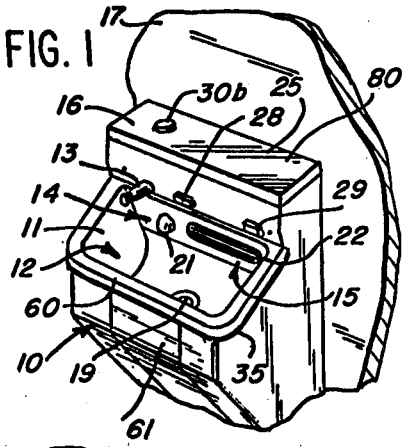
FIG. 1 is a fragmentary perspective view illustrating the mounting of the washing and drying device embodying the invention on a room wall.

As shown in FIG. 1, the bowl 11 defines a lower drain 19 for discharging spent washing water and soap from the device. The drain, as illustrated in FIG. 1, may be centrally located in the bottom of the bowl. As further illustrated in FIGS. 1 and 2, the bowl defines a rear wall 20 in which is mounted a warm water outlet 21 of the warm water supply 14 and a drying air outlet 22 of the air supply 15. As shown, the outlets 21 and 22 may be disposed adjacent the upper rim 23 of the bowl.

Figure 2:
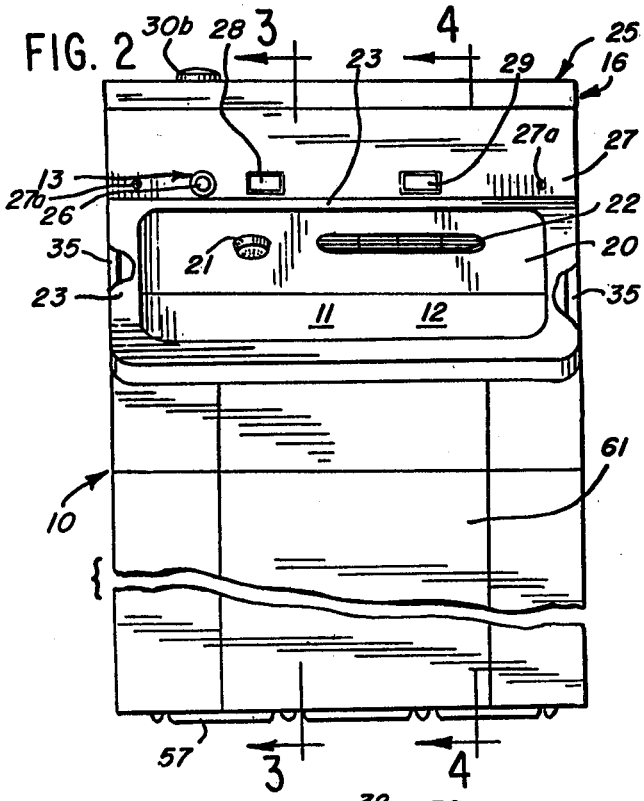
FIG. 2 is a front elevation thereof.

As shown in FIG. 3, the cabinet includes an outer cover portion 25. The soap dispenser 13 is provided with a fill cap **30*b* which projects through cover portion 25. The dispenser 13 includes a manual operating means 26 extending forwardly through the front 27 of the cabinet 16 at the left side thereof, as best seen in FIG. 2. A manually operable control in the form of a pushbutton 28 may be provided in the front cabinet portion 27 above the warm water outlet 21 for controlling the delivery of warm water therethrough. A similar manually operable pushbutton control 29 may be mounted in the cabinet portion 27 above the hot air outlet 22 for controlling the delivery of hand drying air to the outlet 22. As shown in FIG. 2, the controls 28 and 29 are disposed substantially at the level of the top portion of rim 23 for effective operation thereby with the user effectively maintaining his hands within the bowl space 12** in the use of the device.

Figure 4:
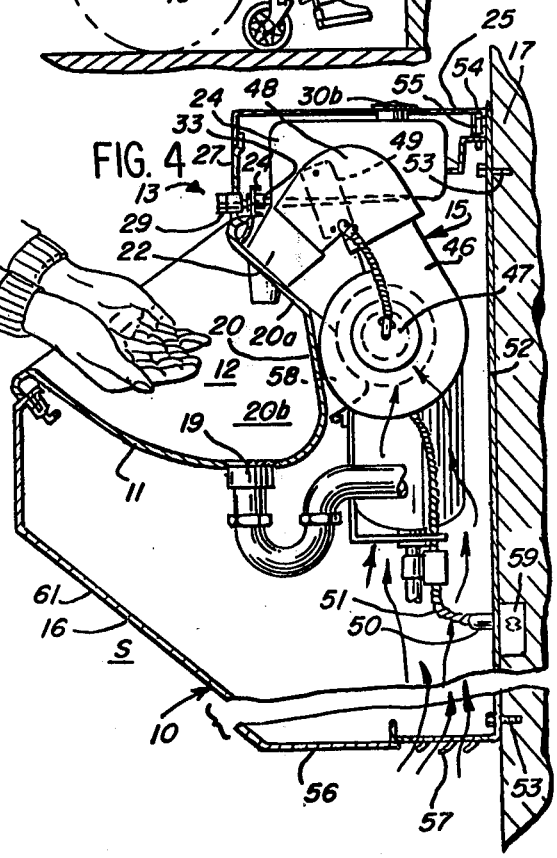
FIG. 4 is a fragmentary vertical elevation taken substantially along the line 4—4 of FIG. 2.

As shown in FIGS. 3 and 4, warm water outlet 21 and drying air outlet 22 are directed downwardly into the bowl space 12. As these outlets are displaced laterally from the drain 19, they direct the fluids delivered therefrom into the space and then along the surface of the bowl.

As shown in FIG. 3, the soap dispenser 13 may include a reservoir 30 mounted within the cabinet 16 by means of a drain fitting **30*a* on the reservoir attached to dispenser 13 and a lug on the rear of the reservoir which rests on a flange of rear cabinet angle 54. As shown in FIG. 3, the warm water control 28 operates a control switch 32 carried on support 24 rearwardly of the cover 25 and as shown in FIG. 4, the control 29 operates a switch 33 also carried on the support 24**.

As shown in FIG. 3, the drain 13 may be connected to a sewer line or the like through a conventional drain trap 34. In the illustrated embodiment, rim 23 of the bowl rests on suitable flanges 35 of the cabinet and is supported by the cabinet rather than by the drain trap which is slidably connected to drain 19, as shown in FIG. 3.

Warm water supply 14 further includes a warm water tank 36 which is carried on a boss 37 of the bowl 11 by means of a suitable bracket 38 on tank 36 and mounting bracket 39 secured to boss 37 by suitable threaded securing means, such as bolts 40. The top of the heating tank is connected to the warm water outlet 21 by a suitable duct 41 and the lower end of the tank is connected to a cold water supply line 42 through a valve 43 controlled by a suitable electric solenoid 44.

As shown in dotted lines in FIG. 3, heating tank 36 may be provided in its lower portion with a conventional heating coil 45 for heating the water in tank 36 to a preselected hand washing temperature. The heating coil is preselected to permit an effective continuous operation of the hand washing and drying device, i.e., by successive persons such as in continuous public restroom or washroom use, and in the illustrated embodiment, may have a low wattage rating such as approximately 1300 watts.

As shown in FIG. 4, the air supply 15 further includes a blower 46 driven by a suitable electric motor 47. The blower delivers the hand drying air to a duct 48 in which is provided an electric heater 49 for suitably warming the hand drying air before discharge thereof through the air outlet 22 in the bowl rear wall 20. In the illustrated embodiment, heater 49 may have a relatively low wattage rating, such as approximately 1600 watts.

As further shown in FIG. 4, device 10 may include a conventional electrical connector plug 50 from which the power cord 51 extends to the different electrical devices within the apparatus.

Cabinet 16 may be hung to the wall 17 by means of a hanger 52 which may be secured to the rear wall by suitable screws 53. The cabinet may include upper hooks 54 adapted to engage suitable mounting bracket means 55 of the hanger 52 to carry the housing on the hanger. As shown in FIG. 4, the housing may define a bottom wall 56 provided with suitable air inlet louvers 57 for permitting air to be drawn upwardly from adjacent wall 17 (FIG. 3) into the cabinet 16 for delivery by blower 46 through the air outlet 22 into the bowl space 12.

As further shown in FIG. 4, blower motor 47 may be mounted to bowl 11 by means of bosses 58. Thus, in the illustrated embodiment, both the warm water supply means 14, including the warm water outlet 21 and the air drying means 15 including the air outlet 22, are supported by the bowl.

In the illustrated embodiment, the cabinet includes a removable front panel 61 permitting access to the space below bowl 11 within the cabinet such as for servicing the apparatus within the lower portion of the cabinet without the need for removing the entire device from the hanger 52.

As shown in FIG. 4, the electrical plug 50 may be arranged to be plugged into a conventional wall power outlet receptacle 59, permitting the device to be installed without requiring special electrical service. The provision of the electrical connector plug 50 in the rear of the cabinet further provides the highly desirable feature of easy plug-in connection to the outlet receptacle 59, as shown in FIG. 4.

The temperature of the water heated in tank 36 is preselected to be the proper temperature for effectively washing the user's hands. Thus, a single water outlet is utilized. By simple arrangement shown in FIGS. 1 and 2, the operation of the device is essentially obvious to the normal user. Thus, the normal operation of the soap dispenser is conventional, and thus obvious, and as the water control is disposed substantially directly above the warm water outlet, the use and functioning of these portions of the device will also be obvious to the normal user. Similarly, the disposition of the air drier control, button 29, directly above the air outlet 22, causes the functioning thereof to be obvious to the normal user. If desired, however, additional legends or suitable additional indicia may be employed.

The hand washing and drying device of the present invention is extremely simple while yet providing an improved hand washing and drying functioning automatically and with minimum energy usage as the maintenance of the user's hands in the bowl during the soaping, washing, rinsing, and drying operations provides optimum utilization of the washing material and hand drying air. Further, as a result of the improved directing of the washing material and hand drying air into the bowl from outlets mounted in the rear wall thereof, an improved sanitized condition of the bowl surface is obtained. Concomitantly, by eliminating flat surfaces adjacent to the narrow rim of the bowl, collection of dirty water and the like is further avoided.

Additionally, the device is readily installed by means of the hanging thereof on the previously mounted hanger simply secured to the wall by means of the mounting screws 53. The automatic covering of the power supply outlet as a result of the installation of the device on the wall provides protection against tampering with the power supply in a novel and simple manner.

The cabinet defines a front opening which is removably closed by the front panel 61, as shown in FIG. 2.

Figure 5:
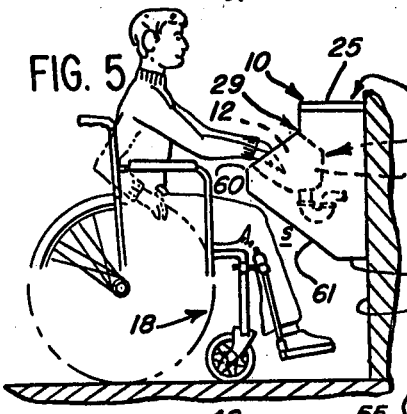
FIG. 5 is a fragmentary side elevation view, partially in section, illustrating the apparatus of the present invention in use by a person in a wheel chair.

The cabinet projects laterally from the wall, with a provision of space below the lower front edge of the bowl, facilitating use of the hand washer dryer as by handicapped persons in wheel chairs as shown in FIG. 5. The portion of the cabinet which includes removable front panel 61 slopes back from the bowl front edge portion 60 to provide a substantial space s in front of the lower portion of the cabinet, and bottom wall 56 is spaced substantially above the floor level. Therefore a person in a wheel chain can roll up to and closely approach the front of the hand washing and drying apparatus and easily manipulate the frontally accessible warm water and warm air controls 28 and 29 and wash and dry the hands within the frontally accessible recessed bowl, all without any undue reaching or strain as shown in FIG. 5. Front portions of the wheel chair and the user's feet and legs can fit underneath front portions of the hand washer and drying apparatus cabinet 16 to facilitate the hand washing and drying operations by a user seated in a wheel chair as shown in FIG. 5.

Referring now to FIG. 6, the control generally designated 63 for controlling the automatic operation of the hand washing and drying device 10 is connected by power cord 51 and plug 50 to the power supply leads L1 and L2 of the wall outlet receptacle 59. The blower pushbutton control 29 comprises a single pole normally closed pushbutton switch connected in series from power supply lead L1 with a single-shot, adjustable timing module 64 of conventional construction providing a single timing output, such as a three-second timing output, as discussed above. The solenoid 44 is connected from the timing module 64 to power supply lead L2 and is arranged to be energized during the three-second "on" time of the module 64 so as to effect a three-second delivery of warm water from the tank 36 each time the water pushbutton 28 is depressed. The water pushbutton 28 includes a first normally open switch **28*a* connected to the timing module 64 to effect the desired operation of solenoid 44. As shown, the blower pushbutton 29 comprises a normally closed switch so that pressing of the blower pushbutton 29 de-energizes the timing module 64, automatically resetting the timing module 64 and requiring a subsequent closing of switch 28*a* to effect a subsequent delivery of the warm water by energization of solenoid 44**.

As further shown in FIG. 6, water pushbutton 28 further controls a normally closed second switch **28*b* connected from power supply lead L1 in series with a normally closed reed switch 65 which is open whenever solenoid 44 is energized. Reed switch 65 is connected in series with a single-shot-adjustable blower timing module 66. A normally open switch 29*a* operated by the blower control pushbutton 29 is connected to the timing module 66 and a blower relay coil 67 is connected from the timing module 66** to power supply lead L2.

The blower relay coil, when energized, opens a normally closed relay switch **67*a* connected in series with a control thermostat 68 on the water heating tank 36 (FIG. 9) and the electric water heater 45 to the power supply lead L2. Energization of blower relay coil 67 further closes a normally open switch 67*b* connected from power supply lead L1 to an air heater safety thermostat 69 connected in series with the blower heater 49 to the power supply lead L2. Blower motor 47 is connected from relay switch 67*b* to the power supply lead L2 in parallel with the series connection of the air heater thermostat 69 and heater 49**.

The operation of control 63 is extremely simple. When the user desires to obtain a preselected quantity of warm water from the water outlet 21, he merely depresses water pushbutton 28, thereby energizing the timing module 64 so as to obtain a three-second operation of the water solenoid 44. At the same time, energization of the solenoid 44 opens the reed switch 65, thereby preventing operation of the blower timer module 66 until completion of the timed operation of solenoid 44. The timer module 64 is arranged in a conventional manner so as to preclude resetting thereof until switch 28*a* is opened by the release of the pushbutton 28 by the user.

Thus, if the pushbutton 28 is jammed in, only a single preselected quantity of warm water is provided by the three-second timed energization of the solenoid 44.

Alternatively, when the blower pushbutton 29 is depressed by the user, the closing of switch 29*a* initiates a timing cycle of the timing module 66 to energize the blower relay 67 for a preselected period of time, such as 40 seconds. Again, the timing module 66 will not reset until the switch 29*a* is released, thereby preventing continuous operation of the blower as by jamming of the pushbutton 29. The depression of water pushbutton 28 opens switch 28*b* associated therewith so as to prevent energization of the timing module 66 or cause resetting of the timing module 66 in the event the timing module 66 is in a timing mode.

The blower relay contacts 67*b* are closed upon energization of the blower relay coil 67 so as to energize the blower heater 49 under the control of the heater safety thermostat 69. Concurrently the blower motor 47 is energized to effect the delivery of warm drying air through the outlet 22 into the bowl space 12.

Water heater 45 is energized at all times when the thermostat switch 68 is closed calling for a heating operation as long as the contacts 67*a* of the blower relay are closed. However, as soon as blower relay coil 67 is energized, further energization of the water heater 45 is terminated by the opening of the switch contact 67*a*, thereby assuring that the maximum load on the power supply is only that of the blower heater 49 and blower motor 47 during the air drying cycle.

In the event that both the pushbutton 28 and pushbutton 29 are depressed concurrently, each of the timing modules 64 and 66 is locked out and no operation of the device is effected.

Thus, each control button 28 and 29, when depressed, terminates operation of the other mode, i.e., if the device is operating in a water delivery mode, depressing of the heater pushbutton 29 terminates the delivery of water and initiates an air drying operation, or where the device is operating in an air drying mode, depression of the water pushbutton 28 discontinues energization of the blower motor 47 and blower heater 49 and initiates a water delivery timed cycle.

At the end of each of the timed cycles controlled by the modules 64 and 66, the modules reset permitting subsequent operation of the device by depression of either of the pushbuttons as desired.

The control assumes that the last pushbutton depressed by the user is the one which the user intends to control the desired operation at that time and, thus, automatically discontinues the previous mode of operation in the event the control is operating in such opposite mode.

In the event either of the pushbuttons is jammed in, upon completion of the initial timing operation, no further operation of the device can be effected until the pushbuttons are released for normal operation as discussed above.

The present invention provides means to effectively preclude energization of the electric water heater until the warm water tank is filled with water upon initial installation of the device. In a presently preferred form of the invention the means comprises a single pole, double throw switch 90 connected to line L1 and arranged to supply power via line 91 to all of control 63, or by switching to contact 92, to supply power directly to water solenoid 44. The control 63 is delivered from the factory with the pole of switch 90 in engagement with contact 92. With the switch 90 in this "install" position the solenoid 44 is continously powered but no other control functions can be actuated. This prevents operation of the other control switches and particularly prevents heating the water tank without water thereby protecting the heating element for the water tank against damage. After the installation is complete the switch 90 is operated to move the pole of the switch into engagement with contact 93 for normal operation of the control.

In another form of the invention a connector 70 may be provided as illustrated in FIGS. 7 and 8 for preventing burnout of the water heater 45 upon initial installation of the device. The connector 70 is arranged to assure that the tank 36 is filled with water before energization of the heating coil 45 is permitted. Thus, as shown in FIG. 7, the connector 70 includes a female part 71 having four female receptacles 72, 73, 74, and 75. The control further includes a male part 76 having four corresponding male terminals 77, 78, 79, and 80. The connector 70 effectively defines a reversible four pole plug and socket assembly. Plug portion 71 includes a plurality of indicia 81 and connector portion 76 includes a corresponding plurality of indicia 82. The terminals 72, 74, 77, 79 and 80 are indicated in FIG. 6 to illustrate the operation of the structure of FIGS. 7 and 8. If the structure of FIGS. 7 and 8 is employed, L1 would be connected to contact 93 and switch 90 would not be required. If provided by the manufacturer, the connector would be arranged as shown in FIG. 8 with male terminal 77 received in female terminal 75, male terminal 78 received in female terminal 74, male terminal 79 received in female terminal 73, and male terminal 80 received in female terminal 72. In this arrangement, the water heater 45 is not connected while the water solenoid 44 is connected so that water may be delivered to the tank prior to permitting energization of the heater 45. When the water supply is connected to the solenoid valve 43, the open condition of the valve permits the tank to fill and to deliver water outwardly from the outlet 21 into the bowl space 12. The water will continue to flow in this manner and outwardly through the drain 19 until the power is disconnected and the connector reversed to the arrangement of FIG. 7 wherein the male terminals are reversely connected to the female terminals. In the reverse arrangement of FIG. 7, the connections to the different electrical elements of the device are as generally shown in FIG. 6, permitting normal operation of the device as discussed above.

Thus, the improved connector 70 is arranged to effectively prevent energizing of the water heater 45 until such time as water is provided in tank 36 so as to effectively preclude damage to the apparatus.

Indicia 81 and 82 provide suitable indication to the user of the connected and disconnected arrangements presented by the alignment of FIGS. 7 and 8, respectively.

As shown in FIG. 10, in one illustrative embodiment of the invention, the hand washer utilized a 66-second cycle period wherein the water was heated for 21 seconds, the heating coil was de-energized for 40 seconds while heated drying air was delivered from the blower, and the water was then again heated for approximately 5 seconds, i.e., during the time necessary for a first user to move away from the apparatus and permit a new user to initiate a subsequent hand washing and drying operation. As further shown in FIG. 10, the 21-second initial water heating period was broken down into an initial three-second pre-wet delivery of warm water onto the user's hands, a 12-second interval during which the user dispensed soap onto his pre-wetted hands and effected a soaping or washing operation, and two successive three-second intervals wherein the user rinsed the soap from his hands into the bowl. During the ensuing 40-second period, the warm water heater 45 was de-energized while the electrical air heater 49 was energized so as to effectively limit the total power demand of the appliance to the maximum 1600 watts of the exemplary air heater 49. Resultingly, in the overall cycle of operation, the water was being heated for 26 seconds out of the total of 66 seconds. it was found that successive repeated hand washing and drying operations utilizing the indicated timing of FIG. 10 was permitted by the apparatus while the water was maintained at the desired warm hand washing temperature in the range of 90° F. to 105° F. utilizing an inlet water temperature of approximately 62° F. To provide the desired hand washing water temperature, the water in the tank was maintained in the range of approximately 95° F. to 110° F.

In the exemplary hand washer, the solenoid valve 43 was arranged to permit a flow of approximately one-half gallon, or 2100 milliliters per minute, so as to provide approximately 105 milliliters during each three-second delivery of the warm washing water. The size of the water tank was one-half gallon (2100 milliliters). The thermostat 68 was set to maintain a temperature of approximately 110° F. at the outlet from the tank 36. As indicated above, the water delivery comprises an open-to-atmosphere system wherein the cold water is delivered to a lower portion of the tank and displaces upwardly the previously heated warm water therefrom to flow outwardly from the top of the tank through the delivery conduit 41 to the water outlet 21.

Thus, the present invention comprehends an improved simplified control for use in providing automatic timed operation of the hand washing and drying device 10 permitting effectively continuous use with effectively minimum energy requirements. Specifically, the device of the present invention can be operated from a single conventional branch circuit connected to a 60 Hertz, 115 volt, 15 ampere power source. This minimizes installation cost and energy usage.

The foregoing disclosure of specific embodiments is illustrative of the broad inventive concepts comprehended by the invention.

The embodiments of the invention in which an exclusive property or privilege is claimed are defined as follows:

1. In a hand washing and drying device having a bowl defining a hand washing and drying space, a water supply including a shutoff valve operated by a water solenoid for delivering hand washing water to said space, and a forced air drying means for delivering hand drying air to said space, an improved control comprising:

first manually operable control means adjacent said space and including a timer means for causing operation of said solenoid for a first preselected short period of time to deliver hand washing water to said space for said preselected period, said timer means being arranged to cause said first period of time to be preselected short period of time to preclude a complete washing and rinsing of the user's hands during one such period thereby requiring a plurality of successive manipulations of the first manually operable means to effect sequentially a plurality of deliveries of hand washing water to effect a complete washing and rinsing of the user's hands; and second manually operable control means associated with said first control means adjacent said space and including a second timer means for causing operation of said forced air drying means for a second preselected longer period of time to deliver hand drying air to said space for said second preselected period.

2. The hand washing and drying device of claim 1 wherein the duration of each of said hand washing deliveries is equal to said first preselected short period of time.

3. The hand washing and drying device of claim 1 wherein each of said water delivery periods of time is approximately three seconds.

4. The hand washing and drying device of claim 1 wherein said first period of time is preselected to provide selectively the proper amount of water for each of a pre-wet operation, a normal wash operation, and a rinse operation.

5. The hand washing and drying device of claim 1 wherein said water supply is arranged to rinse said bowl as an incident of a final manipulating of said first control means by the user.

6. In a hand washing and drying device having a bowl defining a hand washing and drying space, a water supply including a tank, heater means for heating water in said tank, and a shutoff valve operated by a water solenoid for controlling delivery of cold water to said tank for causing delivery of warm hand washing water from said tank to said space, and forced air drying means for deliverying hand drying air to said space, an improved control comprising:

first manually operable control means adjacent said space and including a timer means for causing operation of said solenoid for a first preselected short period of time to cause delivery of warm hand washing water to said space for said preselected period, said timer means being arranged to cause said first period of time to be a preselected short period of time to preclude a complete washing and rinsing of the user's hands during one such period thereby requiring a plurality of successive manipulations of the first manually operable means to effect sequentially a plurality of deliveries of hand washing water to effect a complete washing and rinsing of the user's hands; and second manually operable control means associated with said first control means adjacent said space and including a second timer means for causing operation of said forced air drying means for a second preselected longer period of time to deliver hand drying air to said space for said second preselected period.

7. The hand washing and drying device of claim 6 wherein said heating means is arranged to maintain a supply of warm water in said tank at a preselected hand washing temperature notwithstanding the delivery of warm water therefrom for a plurality of said first periods of time during a complete hand washing and drying cycle time of approximately one minute.

8. The hand washing and drying device of claim 6 wherein said first period of time is approximately three seconds and said second period of time is approximately 40 seconds.

9. The hand washing and drying device of claim 6 wherein said heating means is arranged to maintain the temperature of the water in said tank in the range of approximately 95° F. to 105° F.

10. The hand washing and drying device of claim 6 further including air heating means, said control causing said water tank heater means to be inoperable during operation of said air heating means.

11. The hand washing and drying device of claim 6 wherein said heating means is arranged to permit at least three deliveries of warm water each for one of said first periods of time during each complete hand washing and drying cycle of the device while maintaining the water temperature at least above a minimum of approximately 90° F.

12. The hand washing and drying device of claim 6 wherein said first manually operable control means is arranged to provide sequentially equal length deliveries of warm water for pre-wetting, warm water for washing, and warm water for rinsing.

13. The hand washing and drying device of claim 6 wherein said first manually operable control means is arranged to provide sequentially equal length deliveries of warm water for pre-wetting, warm water for washing, and warm water for rinsing, said first and second control means being arranged to provide a total cycle time of approximately one minute when one each of said pre-wetting, washing, and rinsing deliveries is provided in the total cycle.

14. The hand washing and drying device of claim 6 wherein said first control means is further arranged to be operated during operation of the forced air drying means to terminate operation of the forced air drying means and initiate a water delivery operation.

15. The hand washing and drying device of claim 6 wherein said second period of time is preselected to provide a normal complete drying of the user's hands.

16. The hand washing and drying device of claim 6 wherein said second period of time is preselected to provide a normal complete drying of the user's hands, said second manually operable control means being arranged to provide a plurality of successive operations of the forced air drying means each for said second preselected period of time as desired.

17. The hand washing and drying device of claim 6 wherein said second period of time is preselected to provide a normal complete drying of the user's hands, said second manually operable control means being arranged to provide a plurality of successive operations of the forced air drying means each for said second preselected period of time as desired, said first manually operable control means being arranged to terminate operation of said forced air drying means at any time during any such operation, whereby a subsequent user may immediately initiate a subsequent hand washing operation notwithstanding the device being in a hand drying mode of operation at the time of the desired initiation of the hand washing operation.

18. In a hand washing and drying device having a bowl defining a hand washing space for use in a public restroom, a water supply including a tank, heater means for heating water in said tank, and a thermostat for controlling said heater means, an improved control for providing a supply of water to said space intermittently at a preselected rate and a desired warm temperature despite substantially continuously successive use of said device by a series of persons utilizing the device to wash and dry their hands comprising:

control means including a solenoid valve for controlling delivery of cold water to said tank for causing delivery of warm hand washing water from said tank to said space;

first manually actuatable means adjacent said space and including a timer means for causing operation of said solenoid valve for relatively short period of time preselected to preclude delivery of sufficient washing water to permit a complete washing and rinsing of the user's hands during one such operation of said solenoid valve and thereby requiring a plurality of manual actuations to effect a complete washing and rinsing operation; and forced air drying means including second manually actuatable means associated with said first manually actuatable means adjacent said space for causing a drying of the washed hands in said space, said control means including means arranged to permit energization of the heating means under the control of said thermostat at all times other than during operation of the drying means to cause the delivery of the water from said tank to be at said desired warm temperature.

19. In the hand washing device of claim 18 wherein said solenoid valve comprises a flow control valve adapted to deliver a desired volume of water during a given time interval under various water pressure conditions.

20. In the hand washing device of claim 19 wherein said flow control valve is arranged to deliver approximately 100 milliliters of water when the valve is open for a three second interval.

21. In the hand washing device of claim 18 wherein said timer means comprises a timing module arranged to energize said solenoid valve for said relatively short period of time.

22. In the hand washing device of claim 21 wherein said timing module is a single shot timing module adjusted to energize said solenoid valve for a three second interval.

* * * * *